US009038864B2

(12) United States Patent
Obrist

(10) Patent No.: US 9,038,864 B2
(45) Date of Patent: May 26, 2015

(54) DISPENSING DEVICE FOR DISPENSING A LIQUID GAS FORMULATION IN A METERED MANNER AND METHOD FOR PRODUCING THE DISPENSING DEVICE

(75) Inventor: Gerhard Obrist, Kaiseraugst (CH)

(73) Assignee: ILLINOIS TOOL WORKS INC., Glenview, IL (US)

( * ) Notice: Subject to any disclaimer, the term of this patent is extended or adjusted under 35 U.S.C. 154(b) by 537 days.

(21) Appl. No.: 13/148,107

(22) PCT Filed: Feb. 5, 2010

(86) PCT No.: PCT/IB2010/050535

§ 371 (c)(1),
(2), (4) Date: Oct. 17, 2011

(87) PCT Pub. No.: WO2010/089716

PCT Pub. Date: Aug. 12, 2010

(65) Prior Publication Data

US 2012/0024911 A1 Feb. 2, 2012

(30) Foreign Application Priority Data

Feb. 6, 2009 (CH) ..... 0177/09

(51) Int. Cl.
*B67D 7/60* (2010.01)
*B25C 1/08* (2006.01)
(Continued)

(52) U.S. Cl.
CPC . *B25C 1/08* (2013.01); *B65D 83/64* (2013.01); *B65D 83/663* (2013.01)

(58) Field of Classification Search
USPC ..... 222/380, 386, 387, 389, 399, 394, 222/400.7, 402.16, 635, 386.5; 141/3, 20; 53/266.1, 284.5, 470
See application file for complete search history.

(56) References Cited

U.S. PATENT DOCUMENTS 3,132,570 A * 5/1964 Hoffman, Jr. et al. ..... 92/245
4,673,107 A * 6/1987 Obrist ..... 222/94
(Continued)

FOREIGN PATENT DOCUMENTS

DE 10326474 A1 1/2005
EP 0927610 A2 7/1999

OTHER PUBLICATIONS

ISR for PCT/IB2010/050535 dated May 7, 2010.

*Primary Examiner* — Paul R Durand
*Assistant Examiner* — Andrew P Bainbridge
(74) *Attorney, Agent, or Firm* — Lowe Hauptman & Ham LLP

(57) ABSTRACT

The invention relates to a device for dispensing a liquid gas formulation in a metered manner, wherein the device is particularly suited for use as an injection system in nail driving devices and comprises a pressure-stable container having a flanged rim, to which a valve cover containing a dispensing valve is tightly fastened. The container is equipped with two separated chambers, one of which receives the liquid gas formulation and communicates with the dispensing valve and the other of which contains a driving medium under overpressure. A piston, which can be moved in a sealing manner and which divides the container into the two chambers, is provided in the container. The driving medium is compressed air in combination with a small amount of liquid gas formulation. The flanged rim of the container is designed as an inner flanging. The piston is equipped with a one-way valve arrangement, which allows liquid gas formulation to overflow from the chamber containing the liquid gas formulation into the chamber containing the driving medium. The dispensing device is particularly inexpensive to design and can be cheaply produced and filled in a very simple manner.

23 Claims, 6 Drawing Sheets

Figures 1, 2, 3:
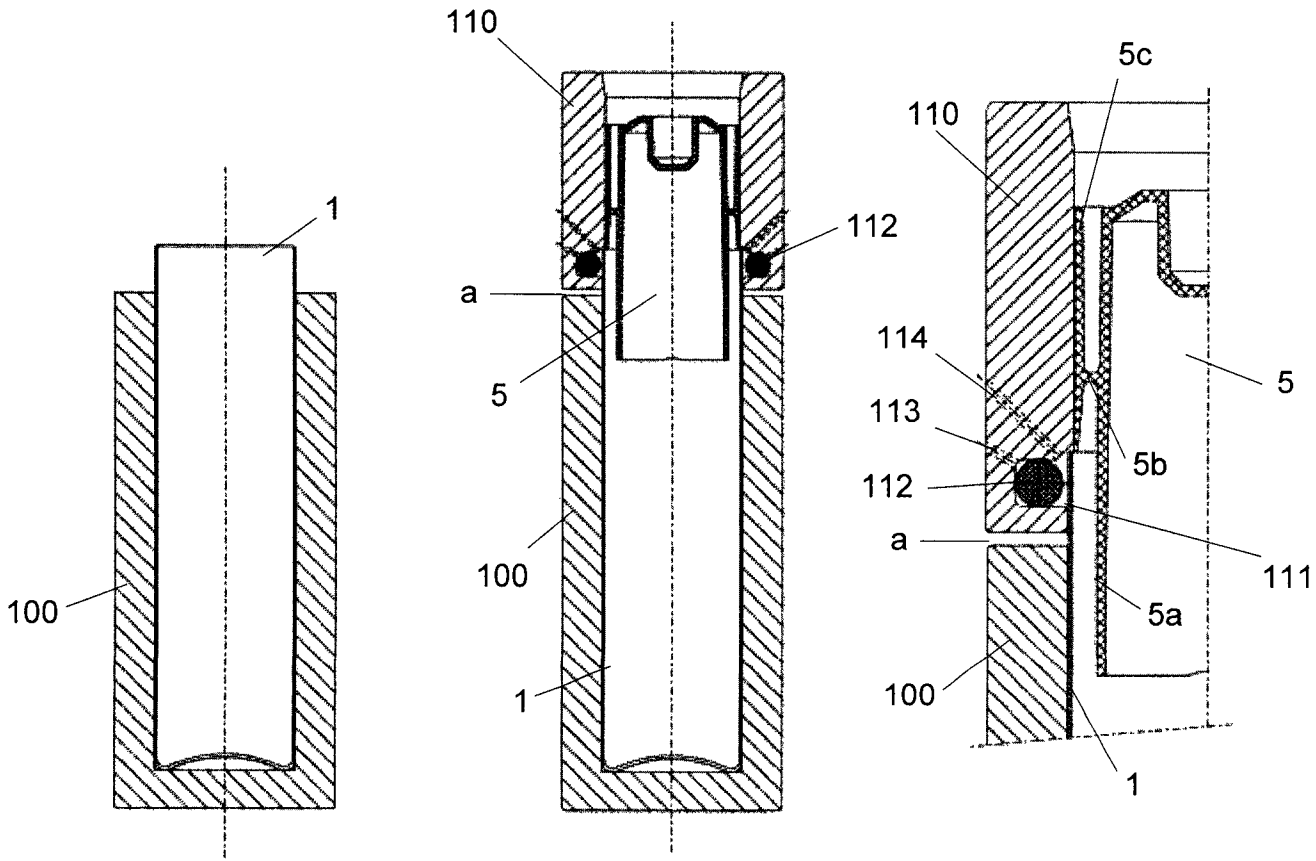

(51) Int. Cl.
*B65D 83/64* (2006.01)
*B65D 83/66* (2006.01)

(56) References Cited

U.S. PATENT DOCUMENTS 4,913,323 A * 4/1990 Scheindel ..... 222/386
5,065,900 A * 11/1991 Scheindel ..... 222/1
5,441,181 A * 8/1995 Scheindel ..... 222/389
6,131,776 A * 10/2000 De Laforcade et al. ..... 222/387
6,158,643 A 12/2000 Phillips
6,260,519 B1 * 7/2001 Phillips ..... 123/46 R
6,332,482 B1 * 12/2001 Runge et al. ..... 141/20
6,341,711 B1 * 1/2002 Blake ..... 220/614
6,345,739 B1 * 2/2002 Mekata ..... 222/389
7,017,772 B2 * 3/2006 Meiland et al. ..... 220/613
7,475,797 B2 * 1/2009 Kim ..... 222/389
7,584,639 B2 * 9/2009 Boltshauser ..... 72/379.4
8,245,888 B2 * 8/2012 Andersen et al. ..... 222/389
8,636,185 B2 * 1/2014 Largo et al. ..... 227/2

* cited by examiner

DISPENSING DEVICE FOR DISPENSING A LIQUID GAS FORMULATION IN A METERED MANNER AND METHOD FOR PRODUCING THE DISPENSING DEVICE

RELATED APPLICATIONS

The present application is national phase of PCT/IB2010/050535 filed Feb. 5, 2010, and claims priority from Swiss Application Number 00177/09 filed Feb. 6, 2009.

The invention concerns a dispensing device for dispensing a liquid gas formulation in a metered manner according to the preamble of independent claim 1 and to a method for producing such a dispensing device according to the preamble of independent claim 7.

For nail driving devices with a linear combustion engine, injection systems in the form of two-chamber aerosol packs are generally used. These two-chamber aerosol packs are filled in a first chamber with a pressurized combustible liquid gas formulation as the useful content. Separated from the useful content by flexible or movable dividing walls, in a second chamber of the aerosol packs there is a likewise pressurized propellant gas or propellant gas mixture, which ensures that the liquid gas formulation remains under sufficiently high positive pressure until emptying is complete. The aerosol packs are equipped with a metering valve, an exactly metered amount of the liquid gas formulation being dispensed upon every actuation of said valve.

One problem with such aerosol packs used as an injection system is that of storage. If stored for a considerable time, the required operating pressure of the liquid gas formulation drops as a result of diffusion effects, and so the function of the aerosol pack or of the nail driving device equipped with it is impaired. This problem could be overcome in principle by a more sophisticated structural design and corresponding choice of construction materials. One argument against this, however, is that such aerosol packs are required in very great numbers, and the expenditure in terms of structural design and material must therefore be kept extremely low for commercial reasons. Furthermore, it must be possible for the filling of the aerosol packs with liquid gas formulation and propellant gas to be performed with as little effort as possible.

The present invention is intended to overcome these problems and improve a dispensing device of the generic type to the extent that it can be produced and filled with extremely low expenditure in terms of structural design and nevertheless stored for a long time without loss of pressure.

The solution achieving this object on which the invention is based is to form the dispensing device according to the characterizing features of independent claim 1. The method according to the invention for producing the dispensing device is provided by the characterizing features of independent claim 7.

Further expedient and particularly advantageous refinements of the invention are the subject of the dependent claims.

The essence of the dispensing device according to the invention is as follows: the device for dispensing a liquid gas formulation in a metered manner comprises a pressure-stable container with a flanged rim, on which a valve cover containing a dispensing valve is tightly fastened. The container is equipped with two separate chambers, one of which receives the liquid gas formulation and communicates with the dispensing valve and the other of which contains a pressurized propellant. Provided in the container is a piston which can be moved in a substantially sealing manner and divides the container into the two chambers. The propellant (L) is compressed air in combination with a comparatively small amount ($F_{ü}$) of liquid gas formulation. The flanged rim (2) of the container (1) is formed as an inner flanging. The piston is formed such that it makes it possible for liquid gas formulation to flow over between the chambers, in the direction from the chamber containing the liquid gas formulation into the chamber containing the propellant. The possibility of overflow between the chambers allows the liquid gas formulation to be introduced into the propellant chamber in a simple and low-cost way.

With preference, the upper side of the piston, facing the valve cover, is adapted in shape to the valve cover with the dispensing valve inserted therein. This achieves emptying of the device with virtually nothing left.

The piston is advantageously equipped with a one-way valve arrangement, which makes it possible for liquid gas formulation to flow over from the chamber containing the liquid gas formulation into the chamber containing the propellant of the container. The one-way valve arrangement is in this case preferably formed by a cylinder lip of the piston lying elastically against the container inner wall or by a non-return valve provided in the piston.

It is also advantageous if the valve cover is sealed with the flanged rim by a sealing compound of a cured plastics material.

The essence of the method according to the invention is as follows: for the production of a dispensing device for a liquid gas formulation, which dispensing device has a pressure-stable container with a flanged rim on which a valve cover containing a dispensing valve is tightly fastened, the container being equipped with two separate chambers, one of which receives the liquid gas formulation and communicates with the dispensing valve and the other of which contains a pressurized propellant, the piston is introduced into the initially still open and not yet flanged container to just below the opening rim thereof, whereby the air located in the container is compressed. Then, the opening rim is flanged inward and in this way the flanged rim is produced. The valve cover with the dispensing valve inserted in it is then tightly fastened on the flanged rim, and in this way the container is closed. The container is filled with a predetermined amount of liquid gas formulation through the dispensing valve, the piston being displaced toward the container base and, as a result, the compressed air enclosed between it and the container base further compressed. Then, the container with the liquid gas formulation located in it is temporarily heated, the liquid gas formulation expanding and a small amount of the liquid gas formulation flowing over into the chamber containing the compressed air between the piston and the container base.

Advantageously, the piston is initially introduced into the initially still open and not yet flanged container only to the extent that it closes the container. Then compressed air at a predetermined positive pressure is introduced into the container. Subsequently, the piston is introduced further into the container to just below the opening rim of the container.

Figure 21:
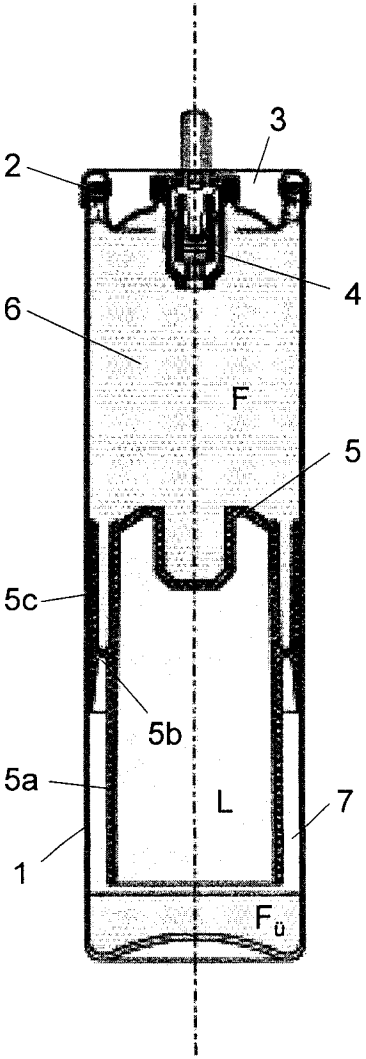

The invention is explained in more detail below on the basis of an exemplary embodiment that is represented in the drawing, in which:

FIGS. 1-20 show axial sections through the dispensing device according to the invention in various phases during the production thereof by the method according to the invention and FIG. 21 shows an axial section through the dispensing device according to the invention in the finished-produced and filled state.

The dispensing device according to the invention that is represented in FIG. 21 comprises a substantially cup-shaped, cylindrical container 1, which is terminated at its upper end (in the drawing) in a way known per se by a valve cover 3, with a dispensing valve 4 inserted therein, fastened tightly to a flanged rim 2. The dispensing valve 4 may also be formed as a metering valve, as used as standard in aerosol packs. Located in the container 1, standing on the base of the container 1, is a piston 5, which divides the interior space of the container 1 or the dispensing device into two chambers 6 and 7 and can slide coaxially in the container in a sealing manner. The piston 5 consists, for example, of polyamide and comprises an inner cylinder part 5*a*, an annular web 5*b* and an outer cylinder lip 5*c*, which lies elastically against the inner wall of the container 1 and is formed such that it forms a one-way valve arrangement, which allows the through-flow from the upper chamber 6, on the valve cover side, into the lower chamber 7, on the base side, when there is sufficient pressure difference between it and the inner wall of the container 1, but blocks the through-flow in the opposite direction. More on this is explained further below in conjunction with the assembly of the dispensing device.

Alternatively, the piston 5 may also be equipped with a one-way valve which allows overflowing from the chamber 6 into the chamber 7. Furthermore, the piston 5 is adapted on its upper side, facing the valve cover 3, to the shape of the valve cover 3 with the dispensing valve 4 inserted therein, as can be seen particularly clearly from FIG. 14. This achieves emptying of the upper chamber 6 with virtually nothing left—see explanations further below.

In the upper chamber 6 of the container 1 or the dispensing device, on the valve cover side, there is as useful content a combustible liquid gas formulation F, for example a butane-propane mixture. In a way known per se, liquid gas formulation F is understood as meaning a substance or a substance mixture which under normal conditions is in the gaseous phase, but under elevated pressure and/or at an appropriately low temperature goes over into the liquid phase. For example, the liquid gas formulation F has a partial pressure of 3.7 bar at a temperature of 20° C., a partial pressure of 7.0 bar at 50° C.

In the lower chamber 7 of the container 1, on the base side, separated by the piston 5, there is as propellant an air cushion L at a positive pressure of about 4.5 bar. Positive pressure is understood as meaning the difference between absolute pressure and the external air pressure. Also located in the chamber 7 is a small amount $F_{ü}$, of the liquid gas formulation, the partial pressure of which is superposed on the pressure of the air cushion.

When, during use, liquid gas formulation F is taken in portions from the dispensing device by opening the metering valve 4, the piston 5 gradually moves toward the valve cover 3 as a result of the positive pressure of the air cushion L. As a result, the lower chamber 7 becomes larger and the pressure of the air cushion L falls correspondingly. The volumes of the two chambers 6 and 7, or of the container 1, are dimensioned such that the air cushion still has a residual positive pressure of about 0.5-0.8 bar when the piston 5 is against the valve cover 3. As a result, a sufficient operating pressure is ensured during the entire emptying of the chamber 6. Furthermore, the adaptation of the shape of the piston 5 to the valve cover 3 with the inserted dispensing valve 4 ensures emptying with virtually nothing left.

It goes without saying that the container 1 is formed with enough pressure resistance to withstand the internal pressure produced by the liquid gas formulation and the air cushion and the partial pressure of the liquid gas formulation within the temperature range specified for the storage and use of the dispensing device (usually a maximum of 12 bar positive pressure).

The dispensing device according to the invention is quite simple in terms of structural design and, according to a further aspect of the invention, can be produced and filled in a particularly simple way. The production method according to the invention is explained below on the basis of FIGS. 1-20.

First, the cup-shaped, cylindrical container 1 is inserted into a supporting holder 100. The container 1 is in this case still not flanged on its opening rim (FIG. 1).

Then, an annular centering tool 110 is positioned coaxially over the supporting holder 100, such that a relatively small gap a remains free between the centering tool and the supporting holder (FIG. 2 and enlarged detail shown in FIG. 3). The centering tool 110 thereby engages with its lower part over the container 1. The centering tool contains in its lower part an annular groove 111, and a sealing ring 112 therein. Furthermore, said centering tool is equipped with a first air supply channel 113, opening into the annular groove 111 radially outside the sealing ring 112, and with a second air supply channel 114, opening into the annular groove 111 above and radially inside the sealing ring 112. There may also be a number of first or second air supply channels provided over the circumference of the centering tool 110. The piston 5 is introduced into the centering tool 110 to the extent that the lower rim of its sealing lip 5*c* lies level with the opening rim of the container 1.

Figure 5:
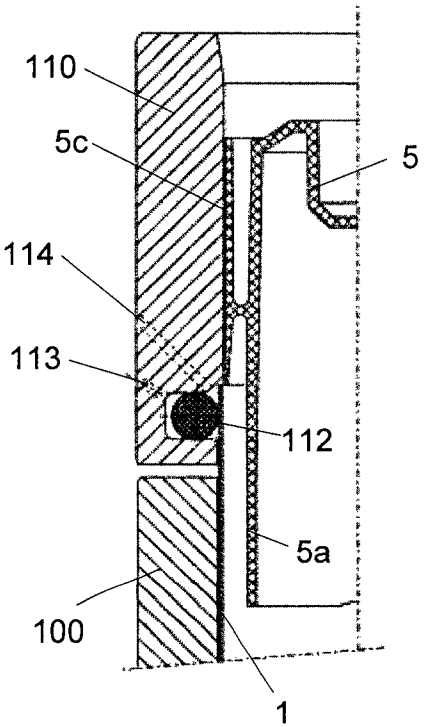
Figure 4:
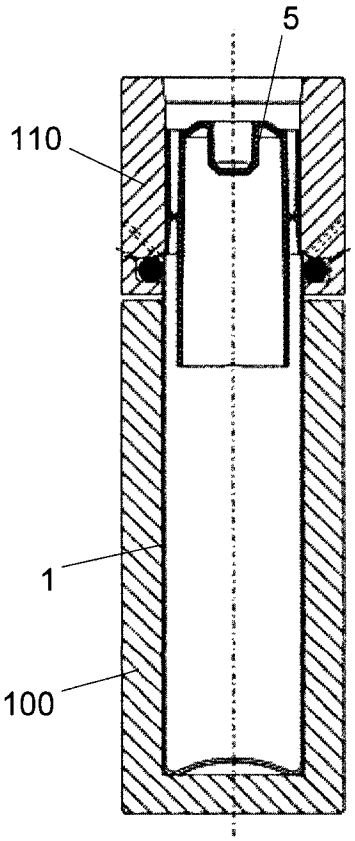

Then compressed air is applied through the air supply channel 113, whereby the sealing ring 112 is pressed radially inward and seals with the outer wall of the container 1 (FIG. 4 and enlarged detail shown in FIG. 5). This may optionally be followed, in a pre-gassing step, by introducing compressed air through the air supply channel 114 into the interior space of the container 1 located under the piston 5.

Figure 6:
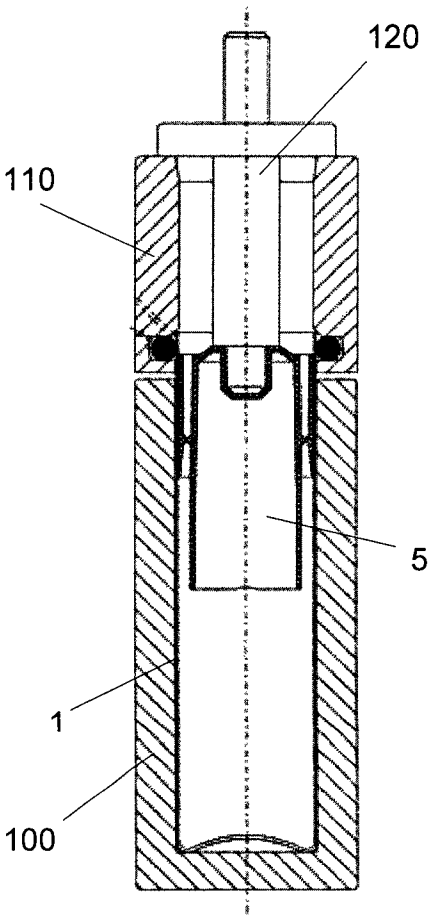

Subsequently, the piston 5 is displaced by means of a ram 120 axially into the container 1 until the upper rim of its sealing lip 5*c* lies somewhat below the opening rim of the container 1. As this happens, the air located in the container 1 is already compressed a little (further) (FIG. 6).

Figure 7:
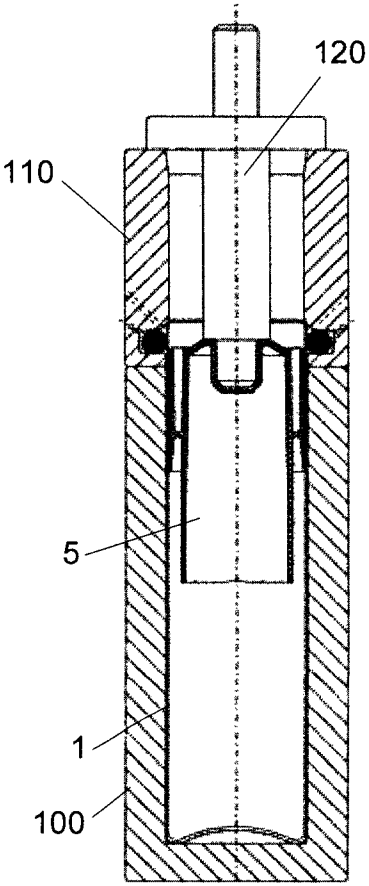
Figure 8:
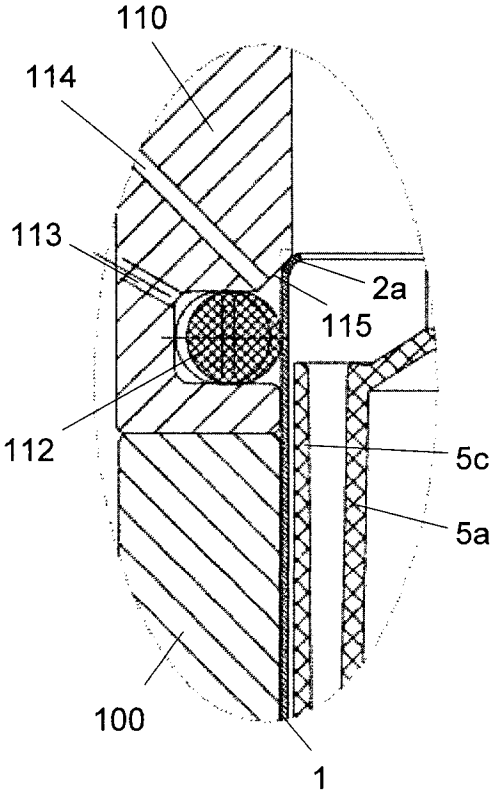

In the next step, the centering tool 110 is placed completely onto the supporting holder 100 (FIG. 7 and enlarged detail shown in FIG. 8). As this happens, the opening rim of the container 1 is deformed inward by a conical bevel 115 of the centering tool 110, such that a slight inner flanging 2*a* is created.

Figure 9:
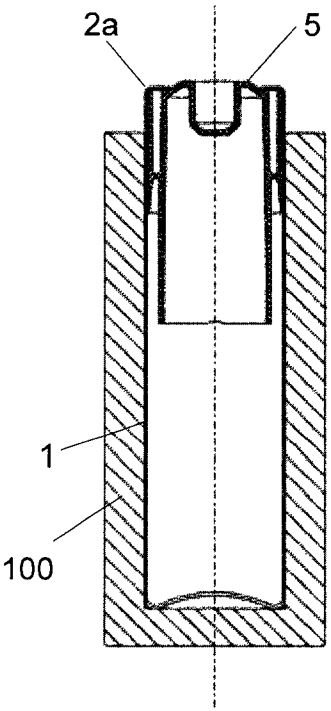

Then the centering tool 110 is removed. As a result of the positive pressure in the container 1, the piston 5 thereby moves upward, until the upper rim of its cylinder lip 5*c* is against the inner flanging 2*a* (FIG. 9). The piston 5 is held back in the container 1 by the slight inner flanging 2*a*. In this phase of production, all there is in the container 1 is the compressed air with a positive pressure of about 0.5-0.8 bar.

Figure 10:
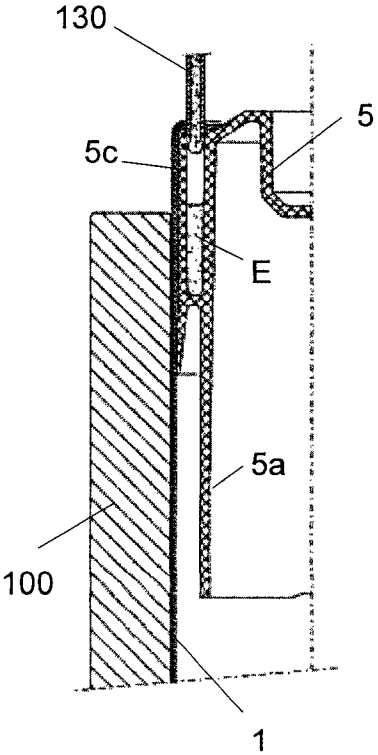
Figure 14:
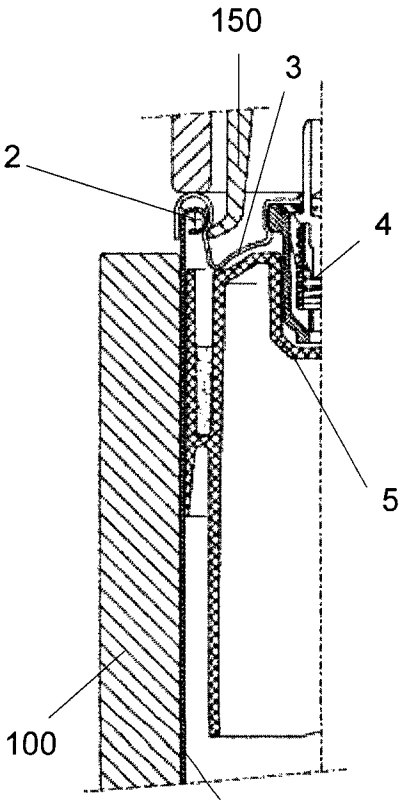

Subsequently, a metered amount of a self-curing sealing compound E, for example an epoxy resin, is introduced into the intermediate space between the inner cylinder part 5*a* and the cylinder lip 5*c* of the piston 5 by means of a metering pin 130 (FIG. 10). This step may alternatively also have already taken place before the piston 5 is introduced into the container 1.

Figure 12:
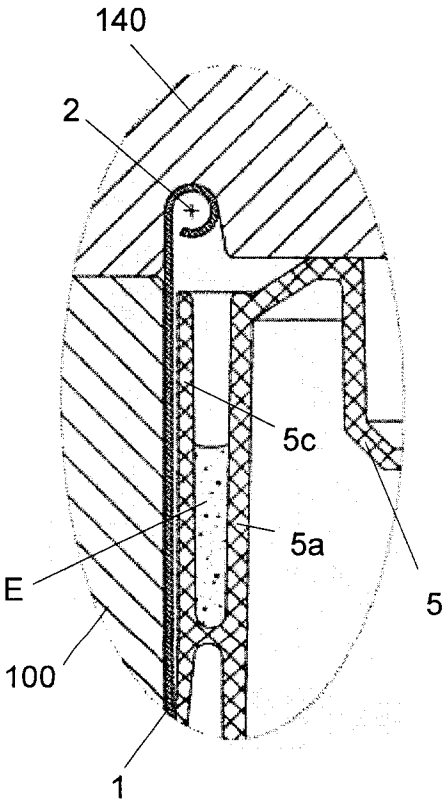
Figure 11:
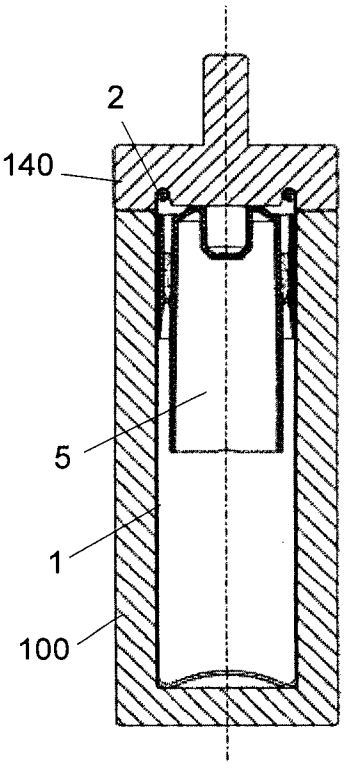

Then a flanging tool 140 is placed onto the container rim and pressed downward as far as the supporting holder 100 (FIG. 11 and enlarged detail shown in FIG. 12). As this happens, the piston is displaced slightly downward into the container 1 and the already slightly flanged opening rim of the container 1 is deformed to give a complete inner flanging (rolled rim) 2. The flanging tool 140 is then removed again.

Figure 13:
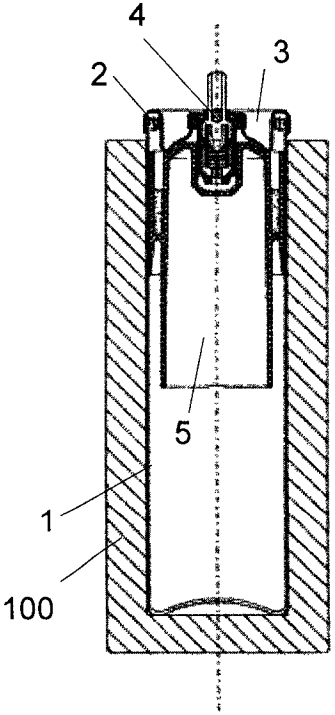

After that, a valve cover 3 with a dispensing valve 4 held in a sealing manner therein is placed onto the flanged rim 2 of the container 1 (FIG. 13). To improve the integrity of the seal, a sealing ring may also be provided in a way known per say between the valve cover 3 and the flanged rim 2. The valve cover 3 is then firmly connected to the container 1 in a way that is conventional per se by means of a clinching tool 150 (enlarged detail shown in FIG. 14).

Figure 16:
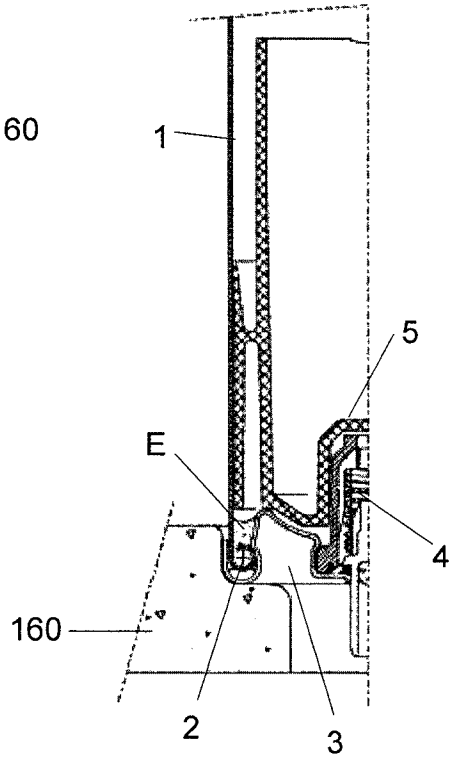
Figure 15:
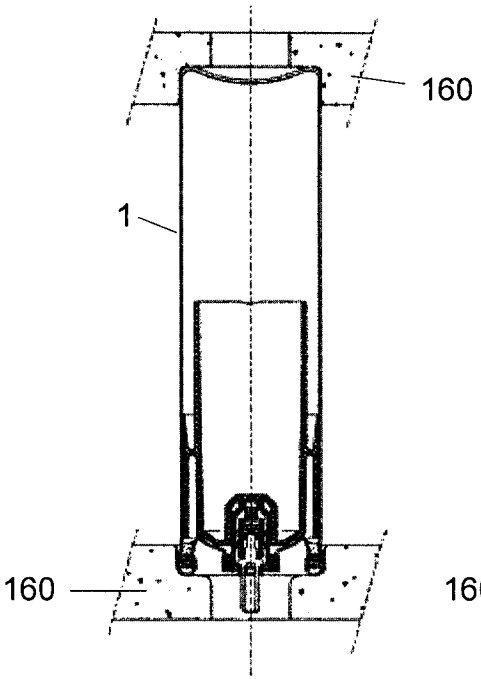

Then the container 1 provided with the valve cover 3 and the dispensing valve 4 held therein is positioned upside down in a transporting package 160 (FIG. 15 and enlarged detail shown in FIG. 16). In practice, the transporting package 160 is formed for receiving a multiplicity of containers 1. The initially still flowable sealing compound E flows to the flanged rim 2 and seals it against the valve cover 3 after a curing time of, for example, about 24 hours. In the transporting package 160, the container 1 is taken for filling, which is usually carried out by a different company than that producing the container ready for filling. If the filling is intended to take place at a time directly after the production of the container itself, it is also possible to dispense with the sealing by means of the self-curing sealing compound E.

The following steps concern the filling of the dispensing device with the liquid gas formulation F.

Figure 18:
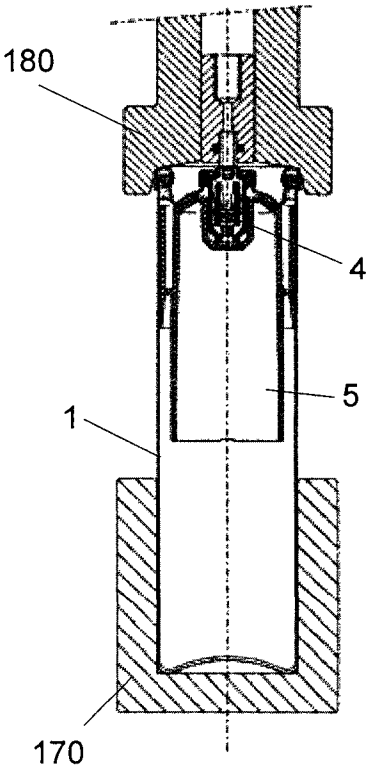
Figure 17:
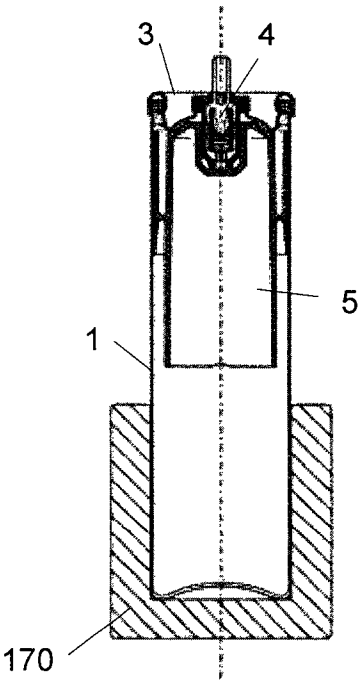
Figure 19:
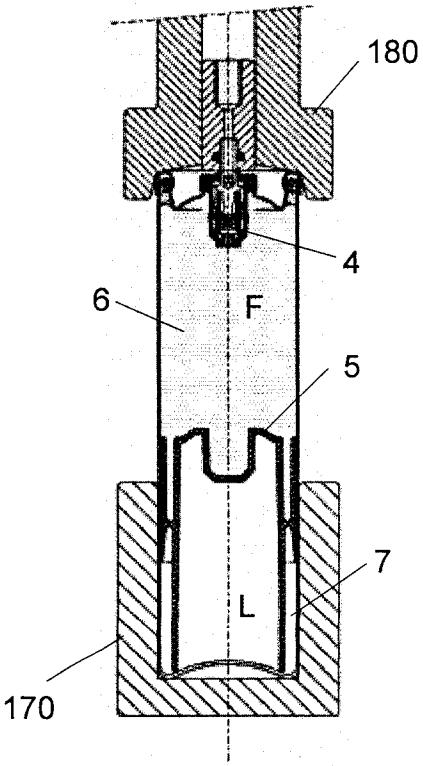

The container 1 provided with the valve cover 3 and the dispensing valve 4 held therein is placed in a receiving device 170 (FIG. 17). Then, a filling tool 180 known per se is brought into sealing contact with the valve cover 2 and a measured amount of liquid gas formulation F is introduced into the container 1 through the dispensing valve 4 in a way known per se (FIG. 18). In the case of a customary size of container (typically 105 ml less the volume of the piston 5), the filling amount may be, for example, 43.5 g, corresponding to around 81 ml (under normal conditions). As this happens, the piston 5 is displaced downward, until it finally stands on the container base (FIG. 19). The air located under the piston is thereby correspondingly compressed further to typically approximately 5-6, in particular about 4.5 bar. The container 1 is divided by the piston 5 into two chambers 6 and 7, of which the upper chamber 6, connected to the dispensing valve, contains the liquid gas formulation F and the chamber 7, located below the piston, initially contains only the compressed air L acting as propellant. The volume of the lower chamber 7 with the piston standing on the container base is typically approximately 25 ml.

Figure 20:
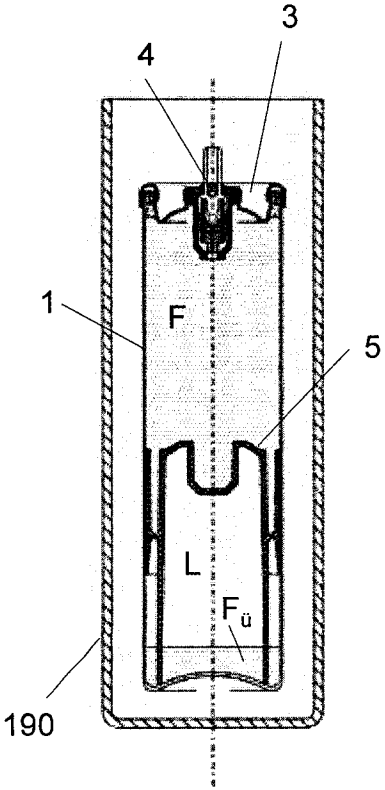

In a final step, the finished-filled container is subjected to a legally prescribed safety test. For this purpose, the filled container is placed in a bath 190 with warm water of a temperature of typically 50° C. (FIG. 20). The partial pressure of the butane-propane liquid gas formulation F that is typically used is around 3.7 bar at 20° C., around 7 bar at 50° C. The liquid gas formulation F expands due to the heating by about 7%, a relatively small part $F_{ü}$, of typically approximately 3.5 g flowing over from the chamber 6 between the inner wall of the container 1 and the cylinder lip 5*c* of the piston 5 into the lower chamber 7, containing the compressed air L. As this happens, in the lower chamber 7 the positive pressure of the air L is superposed by the partial pressure of the liquid gas formulation F. In the upper chamber 6, about 40 g of liquid gas formulation F still remain.

When, finally, the filled container is removed from the water bath, it cools down and the volume of the liquid gas formulation F located in the upper chamber 6 contracts again. The piston 5 thereby moves correspondingly upward a little. The dispensing device is then ready to use (FIG. 21).

The small amount of liquid gas formulation $F_{ü}$, in the propellant chamber 7 ensures that there is always a sufficiently high positive pressure and the dispensing device can in this way be emptied without anything left. According to the invention, the introduction of the small amount of liquid gas formulation $F_{ü}$, into the propellant chamber is performed in conjunction with the in any case required safety testing of the dispensing device, and therefore no separate method steps are required for it.

The dispensing device according to the invention is distinguished by a particularly simple and low-cost way in which it is produced. Furthermore, it has virtually unlimited storability, since the propellant is tightly enclosed and cannot diffuse away through leaks that could exist between the valve cover and the container rim. Therefore, the dispensing device remains operational for a virtually unlimited time. The only diffusion losses that could occur are of the liquid gas formulation, which however would not impair its actual ability to operate.

The invention claimed is:

1. A device for dispensing a liquid gas formulation in a metered manner with a pressure-stable container with a flanged rim, on which a valve cover containing a dispensing valve is tightly fastened, the container being equipped with two separate chambers, one of which receives the liquid gas formulation and communicates with the dispensing valve and the other of which contains a pressurized propellant, characterized in that provided in the container is a piston which can be moved in a substantially sealing manner and divides the container into the two chambers, in that the propellant is compressed air in combination with a comparatively small amount of liquid gas formulation, in that the flanged rim of the container is formed as an inner flanging, and in that the piston is formed such that it makes it possible for liquid gas formulation to flow over between the chambers, in the direction from the chamber containing the liquid gas formulation into the chamber containing the propellant, wherein at least one of:

(i) the device is configured such that the liquid gas formulation flows over from the chamber containing the liquid gas formulation into the chamber containing the propellant of the container upon an expansion of the liquid gas formulation by about 7% relative to that at which would be the case at room temperature when the piston is located such that the volume of the chamber containing the pressurized propellant is at its minimum and the volume of the chamber containing the liquid gas formulation is at its maximum, or (ii) the device includes about 92 percent by mass of the liquid gas formulation of the device being located in the chamber containing the liquid gas formulation and about 8% by mass of the liquid gas formulation of the device being located in the chamber containing the pressurized propellant, and wherein the liquid gas formulation is a pressurized combustible liquid.

2. The device as claimed in claim 1, characterized in that the upper side of the piston, facing the valve cover, is adapted in shape to the valve cover with the dispensing valve inserted therein.

3. The device as claimed in claim 1, characterized in that the piston is equipped with a one-way valve arrangement, which makes it possible for liquid gas formulation to flow over from the chamber containing the liquid gas formulation into the chamber containing the propellant of the container.

4. The device as claimed in claim 3, characterized in that the one-way valve arrangement is formed by a cylinder lip of the piston lying elastically against the container inner wall.

5. The device as claimed in claim 3, characterized in that the one-way valve arrangement is formed by a nonreturn valve provided in the piston.

6. The device as claimed in claim 1, characterized in that the valve cover is sealed with the flanged rim by a sealing compound of a cured plastics material.

7. The device of claim 1, wherein the device is configured to inject the liquid gas formulation into a combustion engine nail driving device, wherein the liquid gas formulation is a pressurized combustible liquid.

8. The device of claim 1, wherein the device is an injection system of a combustion engine nail driving device, wherein the liquid gas formulation is a pressurized combustible liquid.

9. An apparatus, comprising:

a combustion engine nail driving device including the device of claim 1.

10. The device of claim 3, wherein the valve includes a portion that has a cylindrical section having an outer surface that runs parallel to the wall of the container, and wherein the cylinder section includes a first end and a second end opposite from the first end that are separated from the piston by a distance and are only fixed to the piston via elements between the first end and the second end.

11. The device of claim 10, wherein the section is connected to the piston via a web that extends in a radial direction outward from the piston to the section.

12. The device of claim 3, wherein the one-way valve arrangement is configured such that the liquid gas formulation flows over from the chamber containing the liquid gas formulation into the chamber containing the propellant of the container upon an expansion of the liquid gas formulation by about 7% relative to that at which would be the case at room temperature when the piston is located such that the volume of the chamber containing the pressurized propellant is at its minimum and the volume of the chamber containing the liquid gas formulation is at its maximum.

13. The device of claim 3, wherein the device includes about 92 percent by mass of the liquid gas formulation of the device being located in the chamber containing the liquid gas formulation and about 8% by mass of the liquid gas formulation of the device being located in the chamber containing the pressurized propellant, and wherein the liquid gas formulation is a pressurized combustible liquid.

14. An apparatus, comprising:

a device configured to dispense a liquid gas formulation, the device including:

a first chamber; and a second chamber separate from the first chamber, the second chamber configured to contain a pressurized propellant; and a dispensing valve, wherein the device is configured to dispense a fluid contained within the first chamber to an exterior of the device, wherein the device further includes a piston configured to move within the device, thereby adjusting a volume of the first chamber and the second chamber, and forming a boundary between the first chamber and the second chamber, and the device is configured to enable a portion of the liquid gas formulation to flow from the first chamber to the second chamber, and at least one of:

(i) the apparatus is configured so as to permit the fluid to flow over from the first chamber into the second chamber upon an expansion of the fluid of about 7% relative of that at room temperature when the piston is located such that the volume of second chamber is at its minimum and the volume of the second chamber is at its maximum, or (ii) the device includes the fluid, wherein the fluid is a pressurized combustible liquid, and wherein about 92 percent by mass of the fluid is located in the first chamber and about 8% by mass of the fluid is located in the second chamber.

15. The apparatus of claim 14, wherein the dispensing valve is configured to dispense a metered amount of the fluid of the first chamber.

16. The apparatus of claim 14, wherein the device includes a valve attached to the piston, wherein the valve is a one-way valve arrangement that enables the fluid of the first chamber to flow from the first chamber to the second chamber.

17. The apparatus of claim 14, wherein the device is configured to inject the fluid into a combustion engine nail driving device, and wherein the fluid is a pressurized combustible liquid.

18. The apparatus of claim 14, wherein the device is an injection system of a combustion engine nail driving device, and wherein the fluid is a pressurized combustible liquid.

19. An apparatus, comprising:

a combustion engine nail driving device including the apparatus of claim 14.

20. The apparatus of claim 16, wherein the one-way valve includes a portion that has a cylindrical section having an outer surface that runs parallel to wall structure of the device that forms a boundary of the first chamber and a boundary of the second chamber at different locations of the wall structure, and wherein the cylinder section includes a first end and a second end opposite from the first end that are separated from the piston by a distance and are only fixed to the piston via an element between the first end and the second end.

21. The apparatus of claim 20, wherein the section is connected to the piston via a web that extends in a radial direction outward from the piston to the section, the web corresponding to the element.

22. The apparatus of claim 20, wherein the one-way valve arrangement is adapted to permit the fluid to flow over from the first chamber into the second chamber upon an expansion of the fluid of about 7% relative of that at room temperature when the piston is located such that the volume of second chamber is at its minimum and the volume of the second chamber is at its maximum.

23. The apparatus of claim 20, wherein the device includes the fluid, wherein the fluid is a pressurized combustible liquid, and wherein about 92 percent by mass of the fluid is located in the first chamber and about 8% by mass of the fluid is located in the second chamber.

* * * * *